United States Patent [19]

Spidell

[11] Patent Number: 4,819,356

[45] Date of Patent: Apr. 11, 1989

[54] CHANGEABLE SIGN LETTER SUPPORT FOR MARQUEE SIGNS

[76] Inventor: Gilbert Spidell, 1321 Andy, Altus, Okla. 73521

[21] Appl. No.: 77,133

[22] Filed: Jul. 23, 1987

Related U.S. Application Data

[63] Continuation-in-part of Ser. No. 842,581, Mar. 21, 1986, abandoned.

[51] Int. Cl.[4] ..... G09F 7/02

[52] U.S. Cl. ..... 40/618

[58] Field of Search ..... 40/6, 11 R, 618

[56] References Cited

U.S. PATENT DOCUMENTS

| | | | |
|---|---|---|---|
| 1,258,146 | 3/1918 | Russell | 40/618 |
| 2,039,248 | 4/1936 | Huppert | 40/618 |
| 2,093,264 | 9/1937 | Chernow | 40/618 |
| 2,967,366 | 1/1961 | Colbert | 40/618 |
| 3,079,714 | 3/1963 | Zeigler | 40/618 |

*Primary Examiner*—Robert G. Nilson

*Attorney, Agent, or Firm*—Robert K. Rhea

[57] ABSTRACT

In a changeable marquee sign, a plurality of elongated corrugated sheet material racks are horizontally disposed in vertically spaced relation. The ridges of the corrugated shape form forward and rearwardly facing vertical grooves which cooperatively receive spaced-apart longitudinally extending teeth formed on opposing end edge surfaces of a plurality of sign character panels to prevent unauthorized movement of the panels relative to each other or to the plane of the sign. The several panels being chosen to impart a desired message.

3 Claims, 1 Drawing Sheet

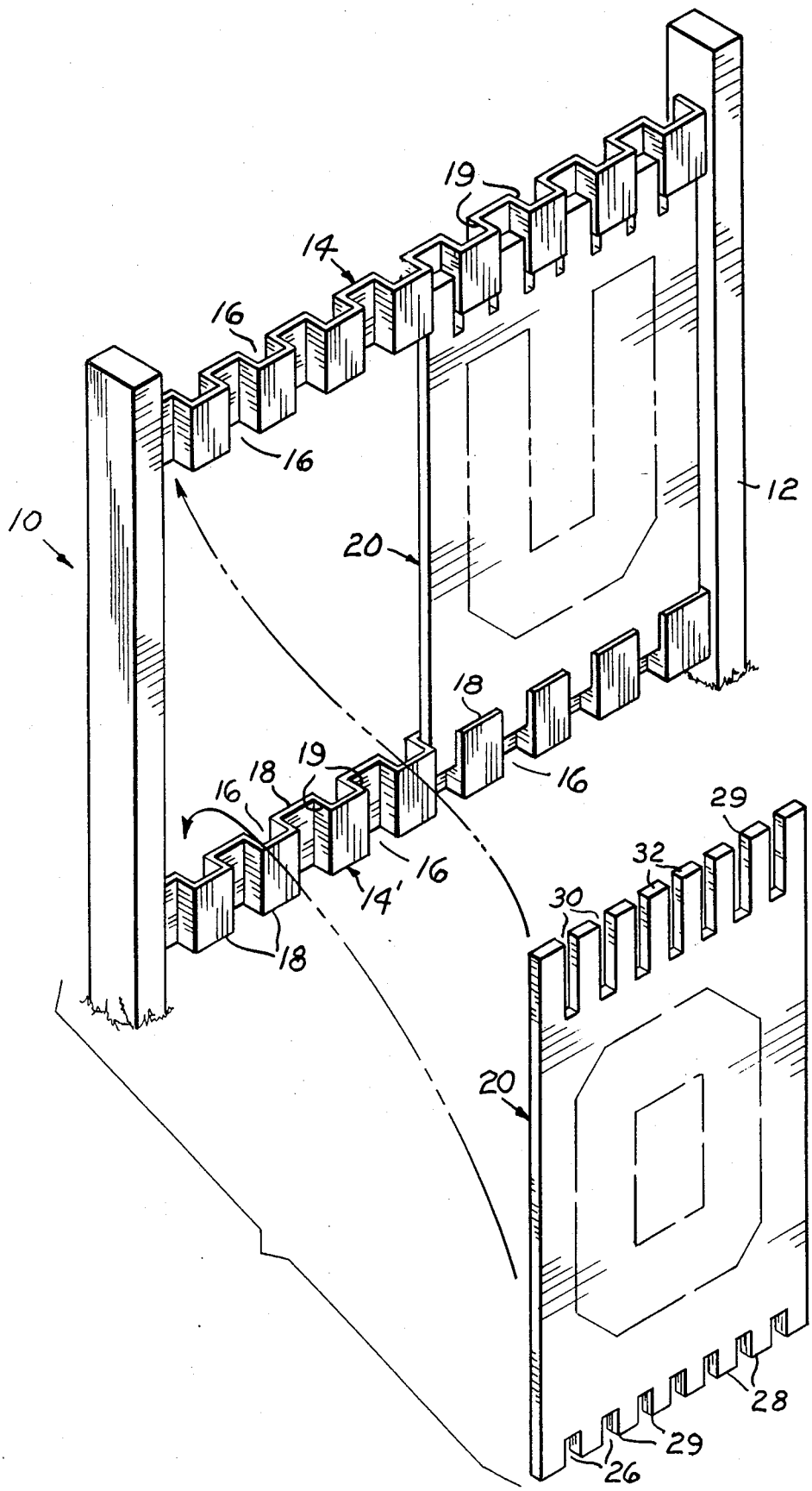
19
14
16
16
12
10
20
18
19
18
16
16
16
29
32
30
14'
18
20
28
29
26

CHANGEABLE SIGN LETTER SUPPORT FOR MARQUEE SIGNS

This invention is a continuation-in-part of an application filed by me in the U.S. Patent and Trademark Office on Mar. 21, 1986, Ser. No. 842,581 for CHANGEABLE SIGN LETTER ASSEMBLY FOR MARQUE SIGNS, now abandoned.

BACKGROUND OF THE INVENTION

1. Field of the invention.

The present invention relates to interchangeable character signs and more particularly to sign character supports.

Marque type signs frequently use changeable sign characters manually mounted on a sign face or support for easily altering or completely changing the desired message to observers. One of the problems frequently encountered with such signs is maintaining the individual sign characters, which as a unit imparts the desired message, from being individually separated one from another on the sign or by being blown off the sign.

This invention provides rails or racks for supporting manually changeable individual sign characters in a manner not easily moved relative to or displaced from its position by high winds or other inclement weather.

2. Description of the prior art.

Prior patents for name plates or information signs featuring changeable sign characters generally disclose serrated edges or saw tooth type cooperating edges formed at the top and bottom of vertically disposed letters or characters which cooperate with a serrated or saw tooth type rack or teeth formed as a part of or on the face of a sign. The sign face comprises a vertically disposed panel extending the full vertical extent of the sign characters or at least extending downwardly or upwardly respectively of the top and bottom supports of the sign character. The purpose of the sign face is to prevent movement of the sign character in a direction toward the sign face. These patents usually feature a sign character grip member or strip impinging the respective top or bottom serrated edge portion of the sign character against the sign face.

This invention is distinctive over all prior patents that I am aware of by providing upper and lower horizontally disposed sign character supporting rails or racks in which the racks are formed in corrugated fashion. Teeth formed on respective upper and lower ends of the sign characters are all alternately disposed within the valleys of the corrugated racks with alternate teeth on respective opposite sides of the rack. This feature eliminates the necessity for a sign face or sign character clamping member at either of its top or bottom end portions to maintain the sign characters in the plane of the sign and prevents lateral movement of the sign characters and forward or rearward movement relative to the plane of the sign.

SUMMARY OF THE INVENTION

Basically the sign assembly comprises a pair of spaced posts or standards defining a substantially vertical plane therebetween to be occupied by a sign formed by changeable characters or letters. A plurality of elongated racks, each coextensive with the spacing between the posts, are disposed horizontally in predetermined vertically spaced relation with the corrugations vertically oriented. The racks are secured at their respective ends to the posts in any conventional manner. In the example shown, the corrugated configuration of the racks form channel-like juxtaposed grooves alternately open to respective vertical surfaces of the sign plane. The grooves, formed by one rack, are preferably disposed in vertical alignment with corresponding grooves formed by the other rack.

The sign assembly further includes a plurality of rectangular flat panels, each having at least one sign character thereon, extending vertically and parallel with the face plane between a selected pair of upper and lower racks. The respective upper and lower end edge portions of the sign character panels are provided with a series of equally spaced notches or U-shaped recesses defining a like series of prongs or teeth cooperatively received in sleeve-like fashion by the grooves of the respective corrugated rack.

The principal object is to provide a marque type sign utilizing upper and lower elongated horizontally disposed corrugated racks attached to a sign support which removably support a series of sign character containing panels extending therebetween in juxtaposed and vertically spaced relation.

BRIEF DESCRIPTION OF THE DRAWINGS

The single figure is a partially exploded perspective view illustrating a sign containing changeable sign character panels supported according to the invention.

DESCRIPTION OF THE PREFERRED EMBODIMENTS

Like characters of reference designate like parts in those figures of the drawings in which they occur.

In the drawings:

The reference numeral 10 indicates a vertically disposed sign support formed by a pair of standards or posts 12. A plurality of elongated sign character panel supports or racks 14 and 14', only two being shown, are horizontally mounted between the posts 12 in predetermined vertically spaced relation. Each of the racks 14 are corrugated in general configuration in which the corrugations, defining juxtaposed channel-like valleys 16, hereinafter called "grooves", and ridges 18, are formed by right angular bends in the sheet material. The ridges 18, in combination with the channel side walls 19 form the grooves 16. The racks 14 are oriented relative to each other so that the longitudinal axis of the grooves in an upper rack is vertically aligned with the respective axis of the grooves in the next lower rack. The length of each rack 14 is general coextensive with the horizontal length of the sign and the vertical height of the corrugated racks is selected in accordance with other parameters presently explained in more detail.

While the ridges and grooves are shown as right angular sheet structure it seems obvious that other corrugated configurations may be employed, such as the conventional corrugated sheet metal sine wave-like arcuate convex and concave corrugated surfaces as long as the sign panel supporting feature is retained. Similarly, the depth of the grooves and height of the ridges is predetermined in accordance with the thickness of the panel material employed in constructing sign character panels, such as the sign panels 20.

Each sign panel 20, having a desired character or symbol thereon, is constructed from rigid sheet material which may be opaque, translucent or transparent and is generally rectangular in flat side elevation defined by parallel opposing vertical edges normal to the respective end edge surfaces. The bottom edge surface of the panel 20 is serrated to define a plurality of equally spaced-apart U-shaped indentations or recesses 26 of a selected depth or vertical length. The width of these grooves 26 is such that they freely receive the side walls 19 forming the sides of the track grooves. The panel end portions, remaining between the respective groves 26, form depending substantially rectangular prongs or teeth 28. The width of the teeth 28 is slightly less than the transverse or inside width dimension of the track grooves so that the teeth may be cooperatively received within the respective groove. Thus the teeth are alternately disposed on the forward and rearward surfaces of the rack. The depth of the recesses 26, defining the length of the teeth, is preferably no greater than one-third the vertical dimension of the support rack 14 or 14' for the purposes presently apparent. The side edge surface of the respective tooth 28 forms a right angle with the surface forming the bight of the respective U-shaped recess 26. The respective free end corner edge of each tooth 28 defines a relatively small radius, as at 29, to facilitate entry of the tooth into the rack grooves.

The top end edge of the sign panel 20 is similarly defined by downwardly extending equally spaced-apart U-shaped indentations or recesses 30 defining a plurality of spaced-apart upstanding projections or teeth 32 longitudinally aligned with the teeth 28 at the opposite end of the sign panel. The longitudinal or vertical dimension of the recesses 30 is preferably twice the longitudinal dimension of the panel lower end recesses 26 for the purposes presently explained.

Similarly, the width of the recesses 30 is at least equal to the thickness of the groove side defining walls 19 and the transverse width of the upstanding teeth 32 is slightly less than the transverse inside dimension of the grooves 16 so that the respective teeth 28 and 32 may be slidably inserted into alternate grooves of the top and bottom racks 14 and 14' for supporting the sign character panels 20.

OPERATION

Assuming a plurality of the racks 14 have been attached to supports such as the posts 12 as described hereinabove, a sign panel 20 having a desired letter or symbol thereon is manually disposed flatly in the vertical plane defined by the posts and the racks. The teeth 32 on its upper end are fully inserted, by manually lifting the panel 20, into alternate grooves 16 formed by the next above rack 14. The sign panel is then lowered relative to the racks so that the lower end edge teeth 28 may, in like manner, fully enter the grooves in the companion rack 14'. This lowering action, to engage the lower teeth with the lower rack leaves approximately one-half the length of the upper end teeth 32 engaged within the upper rack 14 and fully inserts the lower teeth into the groove upper portion of the lower rack 14', thus assuring retention of the sign panel on the rack. This allows other identical sign panels to be supported in like manner above and below the sign panels 20 and similarly allows the panels 20 to be removed/replaced without disturbing such other above and below panels. Other sign panels, not shown, similarly mounted on the racks above, below or laterally adjacent the sign panels 20 convey a desired message. Removal of the sign panels for changing the message s accomplished by reversing the above described installing steps.

Obviously the invention is susceptible to changes or alterations without defeating its practicability. Therefore, I do not wish to be confined to the preferred embodiment shown in the drawings and described herein.

I claim:

1. A changeable character sign, comprising:

a sign support;

a plurality of elongated rack means rigidly secured horizontally in vertically spaced relation to said sign support and defining a sign plane having forward and rearward surfaces, each said rack means having a series of juxtaposed alternately forwardly and rearwardly facing vertically oriented grooves;

a plurality of sign character panels extending between adjacent said rack means and having upper and lower ends; and, means on said panel ends cooperatively engaging said racks for normally preventing lateral movement of said panels relative to each other or the sign plane.

2. The sign according to claim 1 in which the rack means includes:

corrugated sheet material having alternating ridges and valleys and in which adjacent ridges define a groove open vertically and toward the respective forward or rearward surface of the sign plane.

3. The sign according to claim 2 in which the panel end means includes:

a series of equally spaced-apart teeth projecting longitudinally in the plane of the respective panel and cooperatively received by the grooves, the length of said teeth on the panel upper ends being at least twice the length of the teeth on the panel lower ends.

* * * * *